US012520948B2

(12) United States Patent
Vachon

(10) Patent No.: US 12,520,948 B2
(45) Date of Patent: Jan. 13, 2026

(54) EXPANDABLE BED

(71) Applicant: Nathalie Vachon, Sunrise, FL (US)

(72) Inventor: Nathalie Vachon, Sunrise, FL (US)

( * ) Notice: Subject to any disclaimer, the term of this patent is extended or adjusted under 35 U.S.C. 154(b) by 211 days.

(21) Appl. No.: 18/380,766

(22) Filed: Oct. 17, 2023

(65) Prior Publication Data

US 2024/0148152 A1 May 9, 2024

Related U.S. Application Data

(60) Provisional application No. 63/422,433, filed on Nov. 4, 2022.

(51) Int. Cl.

| | |
|---|---|
| ***A47C 19/04*** | (2006.01) |
| ***A47C 21/04*** | (2006.01) |
| ***A47C 27/08*** | (2006.01) |
| ***A47C 27/10*** | (2006.01) |

(52) U.S. Cl.

CPC ..... *A47C 19/04* (2013.01); *A47C 21/044* (2013.01); *A47C 21/048* (2013.01); *A47C 27/10* (2013.01); *A47C 27/082* (2013.01); *A47C 27/085* (2013.01)

(58) Field of Classification Search

CPC ..... A47C 21/044; A47C 21/048; A47C 27/08; A47C 27/081; A47C 27/082; A47C 27/083; A47C 27/084; A47C 27/085; A47C 27/086; A47C 27/087; A47C 27/088; A47C 27/10; A47C 27/12; A47C 27/128; A47C 19/04

See application file for complete search history.

(56) References Cited

U.S. PATENT DOCUMENTS

| | | | | |
|---|---|---|---|---|
| 5,911,657 | A * | 6/1999 | Meiners | A47C 7/021 5/710 |
| 6,108,844 | A * | 8/2000 | Kraft | A47C 17/22 5/713 |
| 9,241,578 | B1 * | 1/2016 | Franken | A47C 31/123 |
| 11,013,341 | B2 * | 5/2021 | Marson | A47C 27/10 |
| 11,191,366 | B2 * | 12/2021 | Alletto, Jr. | A47C 23/0433 |
| 11,259,975 | B2 * | 3/2022 | O'Leary | A61G 7/0514 |
| 11,484,449 | B2 * | 11/2022 | Tumavich | A61G 7/015 |
| 2002/0133883 | A1 * | 9/2002 | Perez | A47C 27/082 5/713 |
| 2004/0064895 | A1 * | 4/2004 | Hochschild | A47C 27/18 5/738 |
| 2006/0021142 | A1 * | 2/2006 | Hornbach | A61G 7/0509 5/613 |
| 2006/0101580 | A1 * | 5/2006 | Biggie | A61G 7/05776 5/713 |
| 2008/0148481 | A1 * | 6/2008 | Brykalski | A47C 21/048 5/423 |
| 2011/0047709 | A1 * | 3/2011 | Tarsaud | A61G 7/05776 33/700 |
| 2012/0297540 | A1 * | 11/2012 | Thomas | A61G 7/0515 5/424 |
| 2015/0247656 | A1 * | 9/2015 | Parish | A47C 21/044 62/3.5 |

(Continued)

*Primary Examiner* — George Sun

(74) *Attorney, Agent, or Firm* — Grogan, Tuccillo and Vanderleeden, LLP

(57) ABSTRACT

A bed assembly includes a frame and a mattress receivable on the frame, the mattress including a plurality of longitudinally-extending sections and at least one bladder. The at least one bladder is inflatable to increase a width of the mattress.

16 Claims, 11 Drawing Sheets

(56) References Cited

U.S. PATENT DOCUMENTS

| | | | | |
|---|---|---|---|---|
| 2017/0049242 | A1* | 2/2017 | Franken | A47C 31/123 |
| 2017/0143566 | A1* | 5/2017 | Elku | A61G 7/0512 |
| 2020/0138656 | A1* | 5/2020 | Davis | A61G 7/001 |
| 2021/0045950 | A1* | 2/2021 | Connell | A61G 7/015 |
| 2023/0248599 | A1* | 8/2023 | Ross | A61G 7/002 5/713 |

* cited by examiner

EXPANDABLE BED

CROSS-REFERENCE TO RELATED APPLICATIONS

This application claims the benefit of U.S. Provisional Application Ser. No. 63/422,433, filed on Nov. 4, 2022, which is hereby incorporated by reference herein in its entirety.

FIELD OF THE INVENTION

The present invention relates generally to beds and, more particularly, to a bed that can be expanded and contracted to accommodate different sized patients and equipment that may be necessary to carry with the patient as they are moved in a hospital or health care facility.

BACKGROUND OF THE INVENTION

Hospital beds are well known in the art. Many hospital beds are positionable to a configuration having the sleeping surface of the bed at a predetermined height above the floor and having siderails positioned to restrain the movement of a person lying on the sleeping surface past sides of the sleeping surface and off of the bed. The sleeping surfaces of many such hospital beds can typically be lowered to reduce the distance between the sleeping surface and the floor, and the sleeping surfaces of such beds can often be manipulated to adjust the position of the person on the sleeping surface. In addition, the siderails of these hospital beds can typically be moved to a position away from the sleeping surface to facilitate movement of the person on the sleeping surface from the supine position on the sleeping surface to a standing position on the floor near the bed.

Often when a patient is admitted through the emergency room, arrangements must be made to provide a room and bed for the potential patient. Many times, there may be rooms available but no beds to accommodate the patient (and the emergency room bed may not be suitable for a patient's needs upon admission and/or the emergency room bed may need to remain in the emergency room for subsequent use by other patients).

In view of the above, there is a need for a flexible, adjustable bed that can remain with a patient from the emergency room, through transport and admission, and throughout a patient's stay in the hospital or healthcare facility.

SUMMARY OF THE INVENTION

It is an object of the present invention to provide a bed for a patient in a hospital or healthcare facility.

It is another object of the present invention to provide a bed that can stay with a patient during a patient's time in the emergency room, transport (from emergency room to admission, and/or to diagnostic testing stations, operating rooms, etc.) and admission.

It is another object of the present invention to provide a bed that is expandable and retractable to accommodate different sized patients and equipment.

It is another object of the present invention to provide a bed that simplifies the transport of patients.

It is another object of the present invention to provide a bed that is able to meet a patient's needs throughout an entirety of a patient's stay in a healthcare facility.

It is another object of the present invention to provide a bed having an adjustable firmness level.

These and other objects are achieved by the present invention.

According to an embodiment of the present invention, a bed assembly includes a frame and a mattress receivable on the frame, the mattress including a plurality of longitudinally-extending sections and at least one bladder. The at least one bladder is inflatable to increase a width of the mattress.

According to another embodiment of the present invention, a method for configuring a bed includes the steps of providing a mattress having a plurality of solid sections and a plurality of air bladders interposed between the plurality of solid sections, and inflating the plurality of air bladders to increase a width of the mattress.

According to yet another embodiment of the present invention, an expandable bed system includes a frame, a mattress receivable on the frame, the mattress a plurality of solid sections and a plurality of air bladders interposed between the plurality of solid sections, and source of pressurized air in fluid communication with the plurality of bladders. The plurality of bladders are inflatable to increase a width of the mattress.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
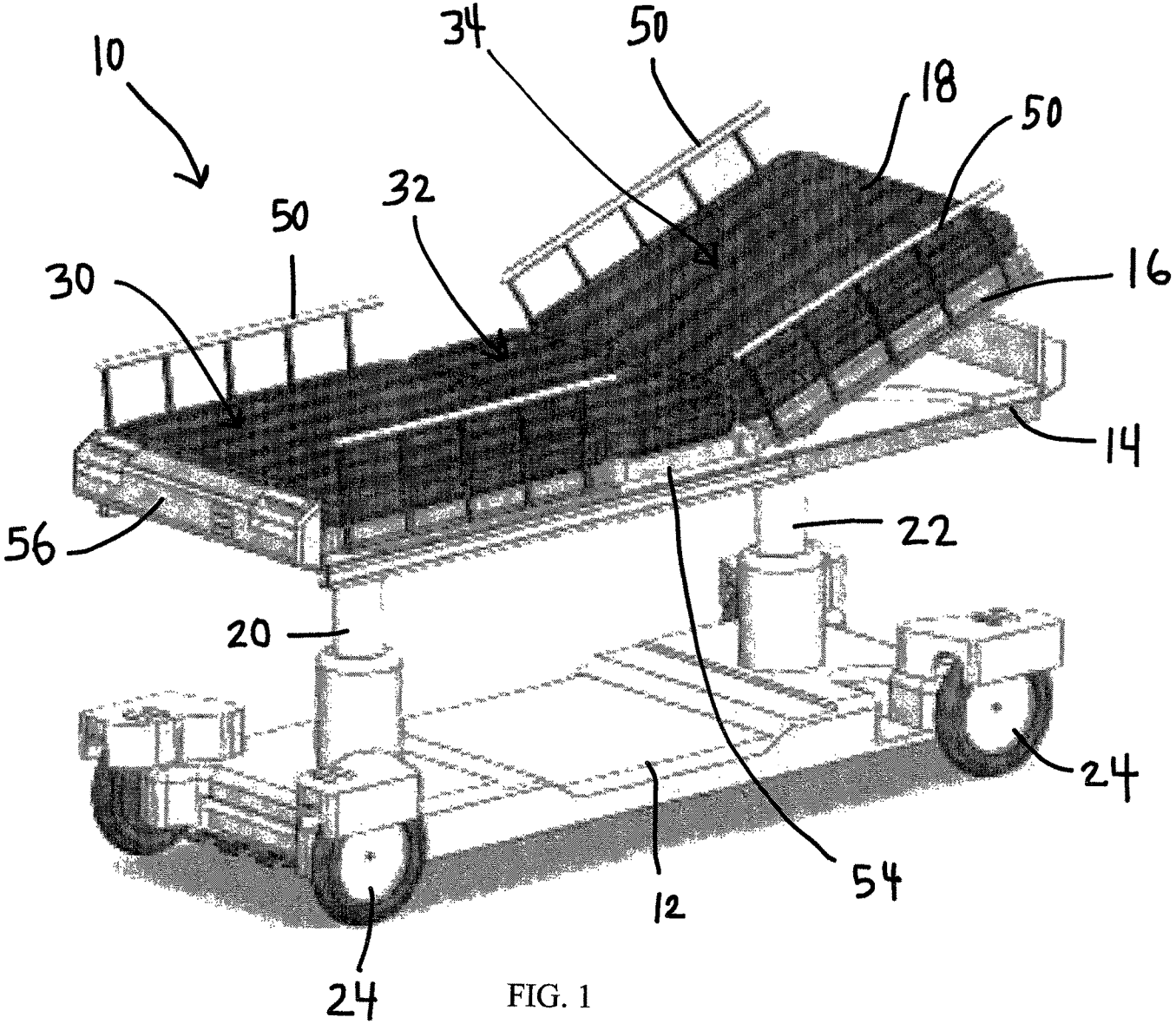
FIG. 1 is a perspective view of a bed according to an embodiment of the present invention.

With reference to FIG. 1, a bed 10 (also referred to herein as "bed assembly 10") according to an embodiment of the present invention is illustrated. As used herein, "bed" or "bed assembly" means a device for supporting a patient in sitting or lying position. The bed of the present invention has wide application and may be used in a variety of situations. The improvements disclosed herein may be used on beds in general, on medical tables, stretchers, gurneys, and so forth.

As shown therein, the bed 10 includes a base 12, a support table 14, a frame 16 atop the support table 14, and a mattress 18 removably received atop the frame 16. In and embodiment the support table 14 is received atop a pair of actuators 20, 22 connected to the base 12, which are operable to raise or lower the support table 14, frame 16 and mattress 18 relative to the base 12. The actuators may take the form of any type of actuator known in the art such as, for example, a hydraulic actuator, pneumatic actuator, electric actuator, lead screw or the like. While FIG. 1 illustrates the actuators 20, 22 as being linear actuators, the present invention is not intended to be so limited in this regard, and any means for raising and lowering the support table 14 relative to the base 12 may be utilized. Moreover, in an embodiment, the support table 14 may be omitted in which case the frame 16 may be received by the actuators. As also shown in FIG. 1, the base 12 may include a plurality of wheels or casters 24, proving for movement of the bed assembly 10 around a hospital or healthcare facility.

Figure 2:
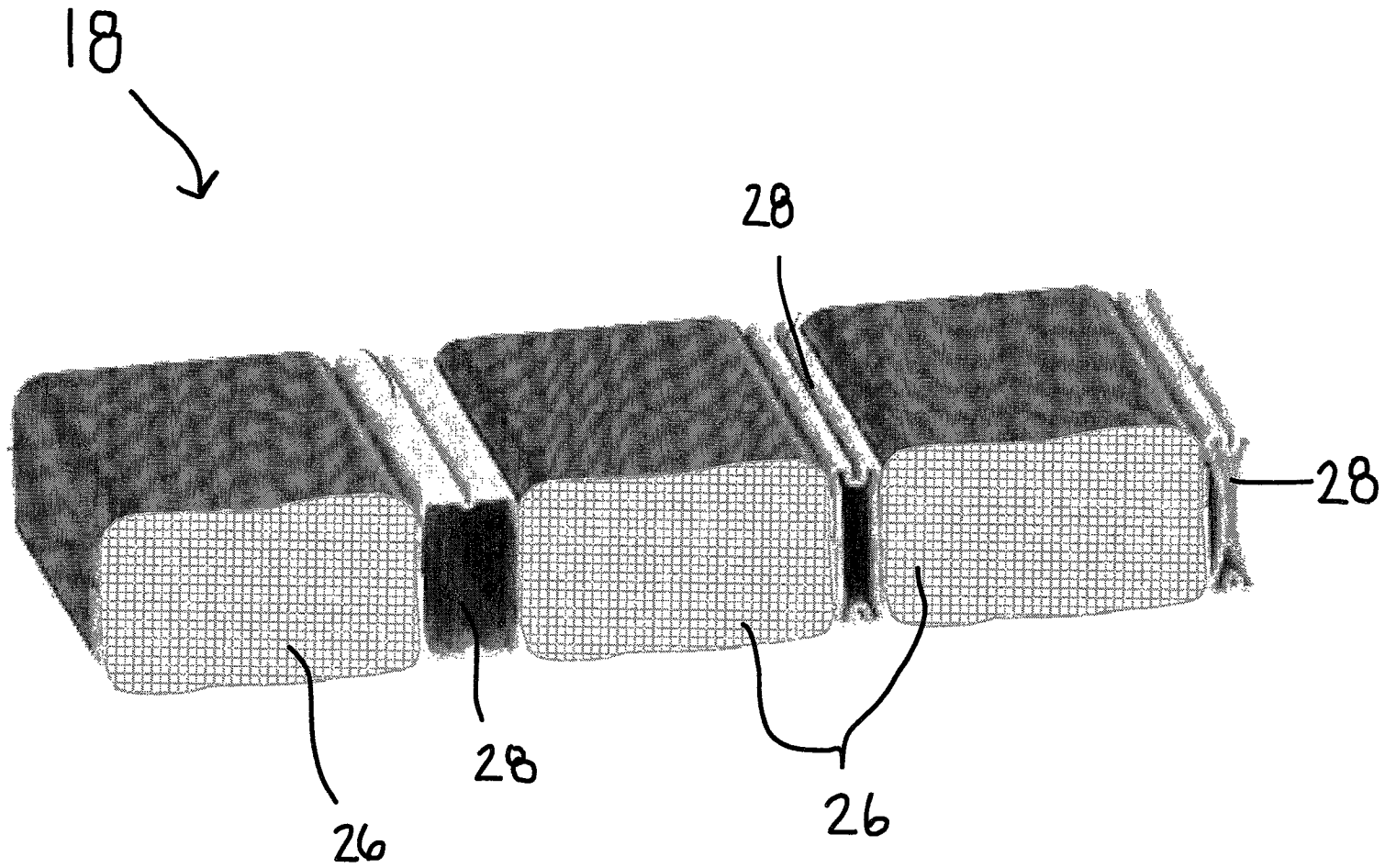
FIG. 2 is a cross-sectional, perspective view of a mattress of the bed of FIG. 1, according to one embodiment of the present invention.

With reference to FIG. 2, in an embodiment, the mattress 18 is an adjustable mattress, having a selectively adjustable width. As illustrated therein, in an embodiment, the mattress 18 includes longitudinally extending solid sections 26 spaced apart by longitudinally extending bladders 28. The solid sections 26 may be formed of, for example, memory foam, gel or other foam material, a gel material having a honeycomb structure (or other porous, cellular structure) although other materials known in the art may also be utilized for the solid sections 26. As used herein, "solid" is intended to encompass porous materials, as differentiated from the bladders 28 having a large air pocket. In an embodiment, the sections 26 may have a waterproof or water resistant covering. The bladders 28 may be formed form any flexible or elastomeric material and are capable of receiving a fluid such as air. In an embodiment, there are a plurality of solid sections 26 and a plurality of bladders 28. In an embodiment, there are at least three solid sections 26 and at least two bladders 28. The bladders 28 are fluidly connected to a source of fluid such as air, and can be inflated to expand the width of the bladders 28, and thus the mattress 18, as discussed in detail hereinafter. For example, the bed assembly 10 may have a compressor or pressurized air tank that can be utilized to inflate the bladders 28 and thus increase the width of the mattress 18, as desired. Alternatively, the bed assembly 10 may have a connector for connecting the bladders 28 to an off-board source of pressurized air. The bed assembly 10 may also include a source of suction for deflating the bladders 28 to decrease the width of the mattress 18. Importantly, the bladders 28 are configured so as to expand in the lateral/horizontal direction, with only minimal expansion in the vertical direction.

As best shown in FIG. 1, the mattress 18 may have a plurality of distinct regions, including a lower region 30, an intermediate region 32, and an upper region 34, allowing the mattress 18 to be moved between flat and inclined positions. In an embodiment, the solid sections 26 and bladders 28 of each region may be separate. In other embodiments they may be contiguous and fluidly interconnected.

Figure 3:
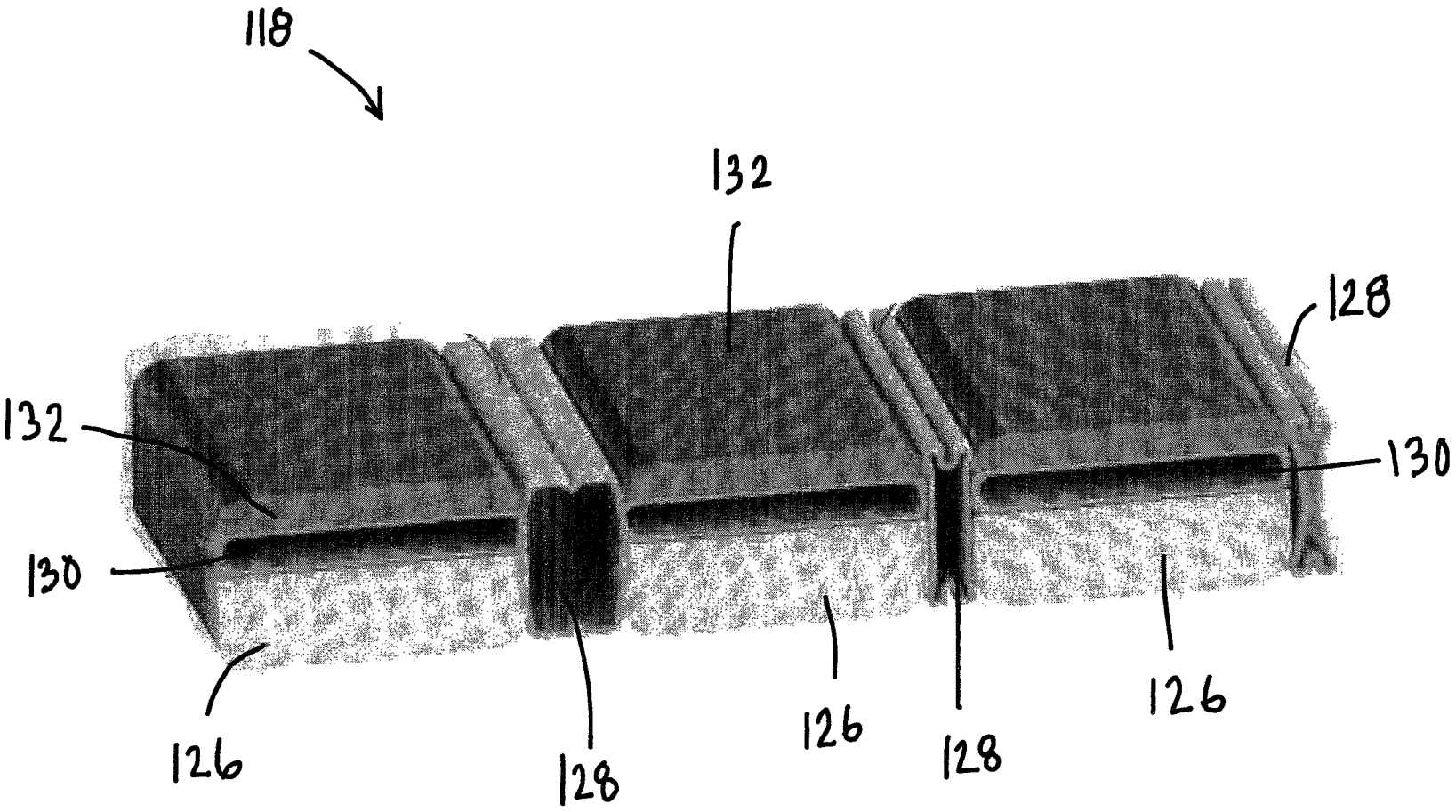
FIG. 3 is a cross-sectional, perspective view of a mattress of the bed of FIG. 1, according to another embodiment of the present invention.
Figure 4:
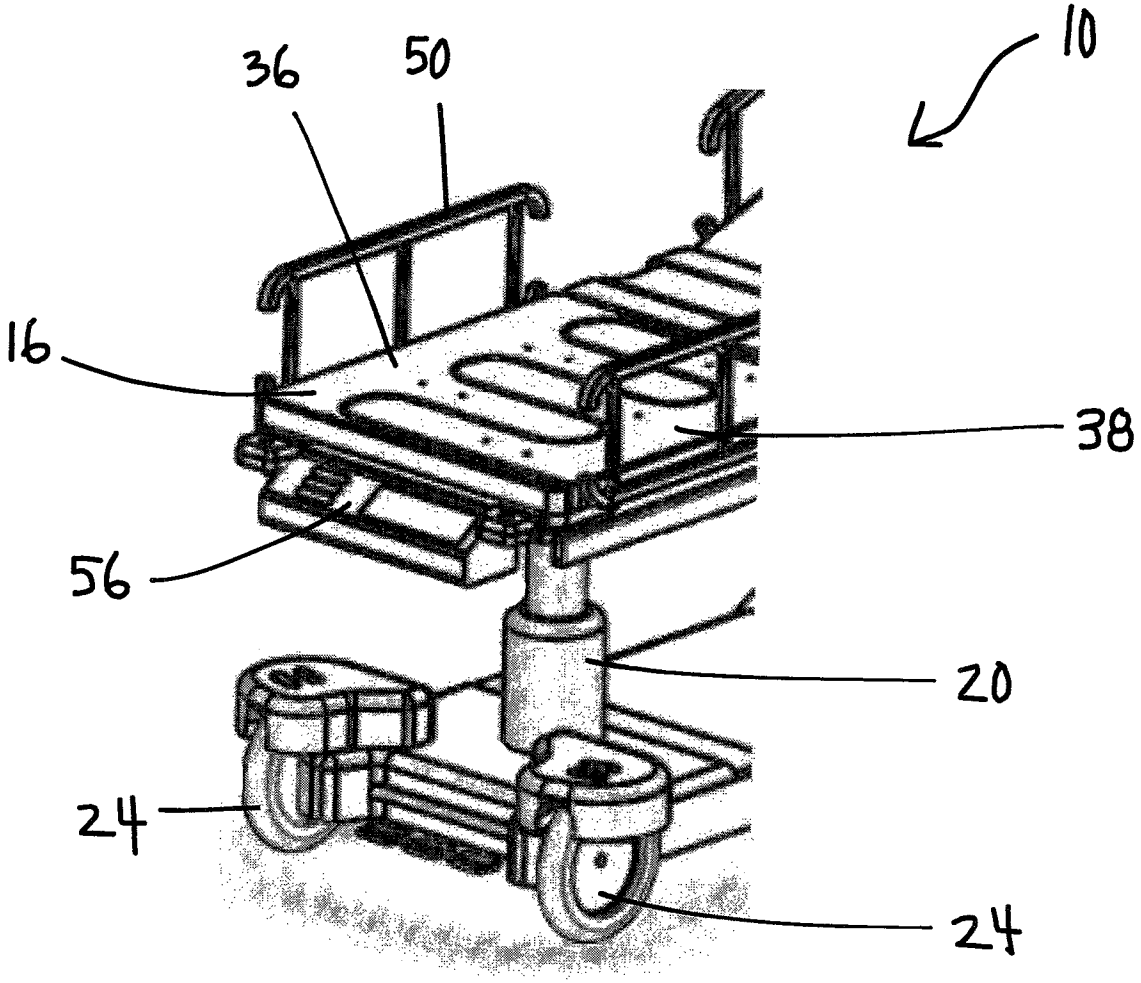
FIG. 4 is an enlarged, perspective view of a of portion of the bed of FIG. 1.

FIG. 3 illustrates a mattress 118 according to another embodiment of the present invention. As shown therein, the mattress 118 includes a plurality of sections 126 separated by flexible bladders 128. The bladders 128 may be constructed similarly to bladders 28 disclosed above, and can be inflated and deflated in the manner hereinbefore described. The sections 126 include a base layer 130 of gel, memory foam or other solid material (which may be a porous material), an intermediate layer defining an air bladder 130, and a top layer 132 of gel or memory foam. The air bladders 130 are fluidly separate from the bladders 128, however, in other embodiments they may be fluidly connected. The bladders 130 may be fluidly connected to a source of air and/or vacuum, allowing for selective inflation and deflation of the bladders 128 to increase or decrease the firmness of the mattress 118.

In either embodiment, the air bladders 28, 128, 130 may be utilized to increase the firmness of the bed on demand, which may be useful when needing a solid surface for performing CPR.

Figure 10:
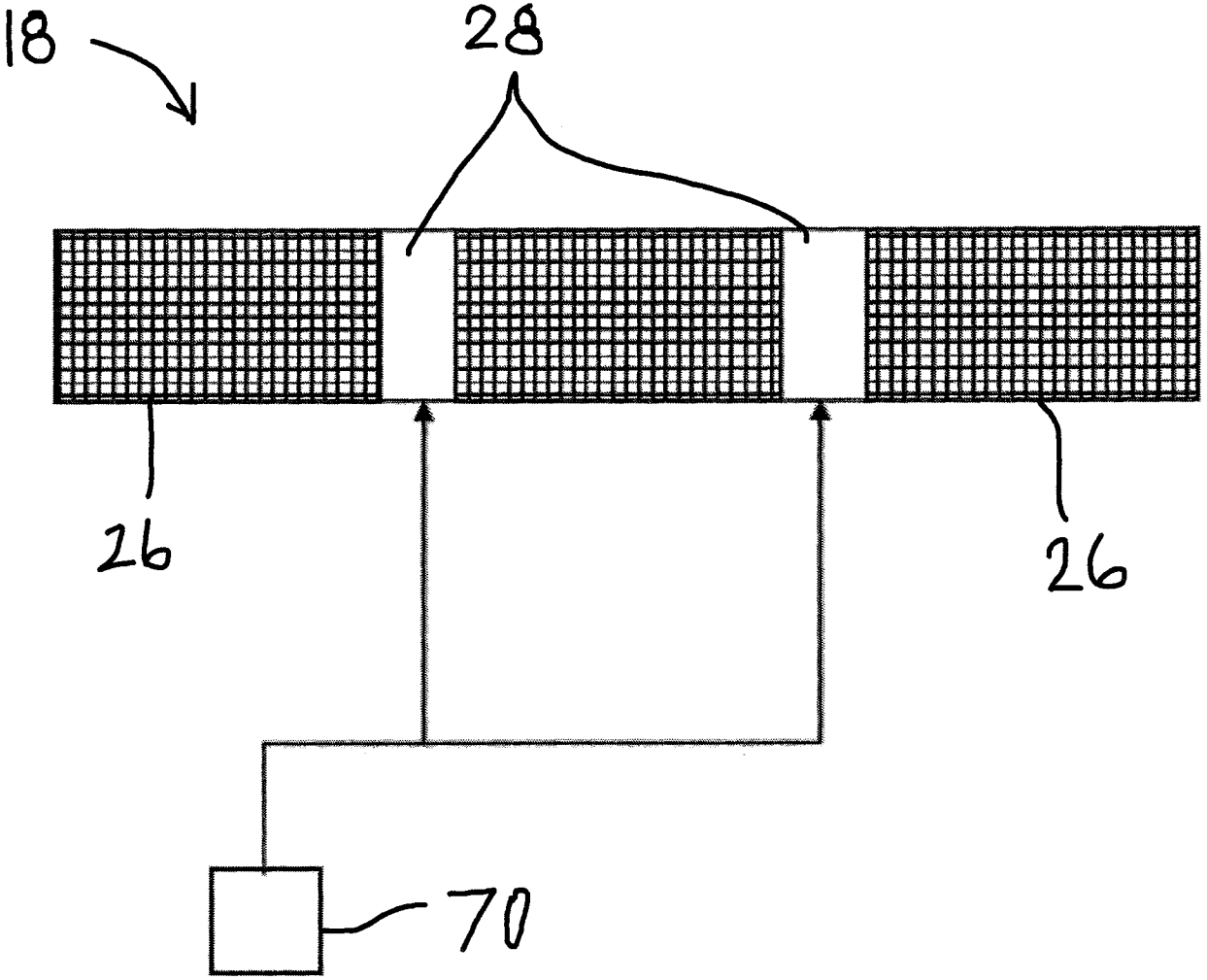
FIG. 10 is a schematic illustration of an air supply system for the bed, according to an embodiment of the invention.
Figure 11:
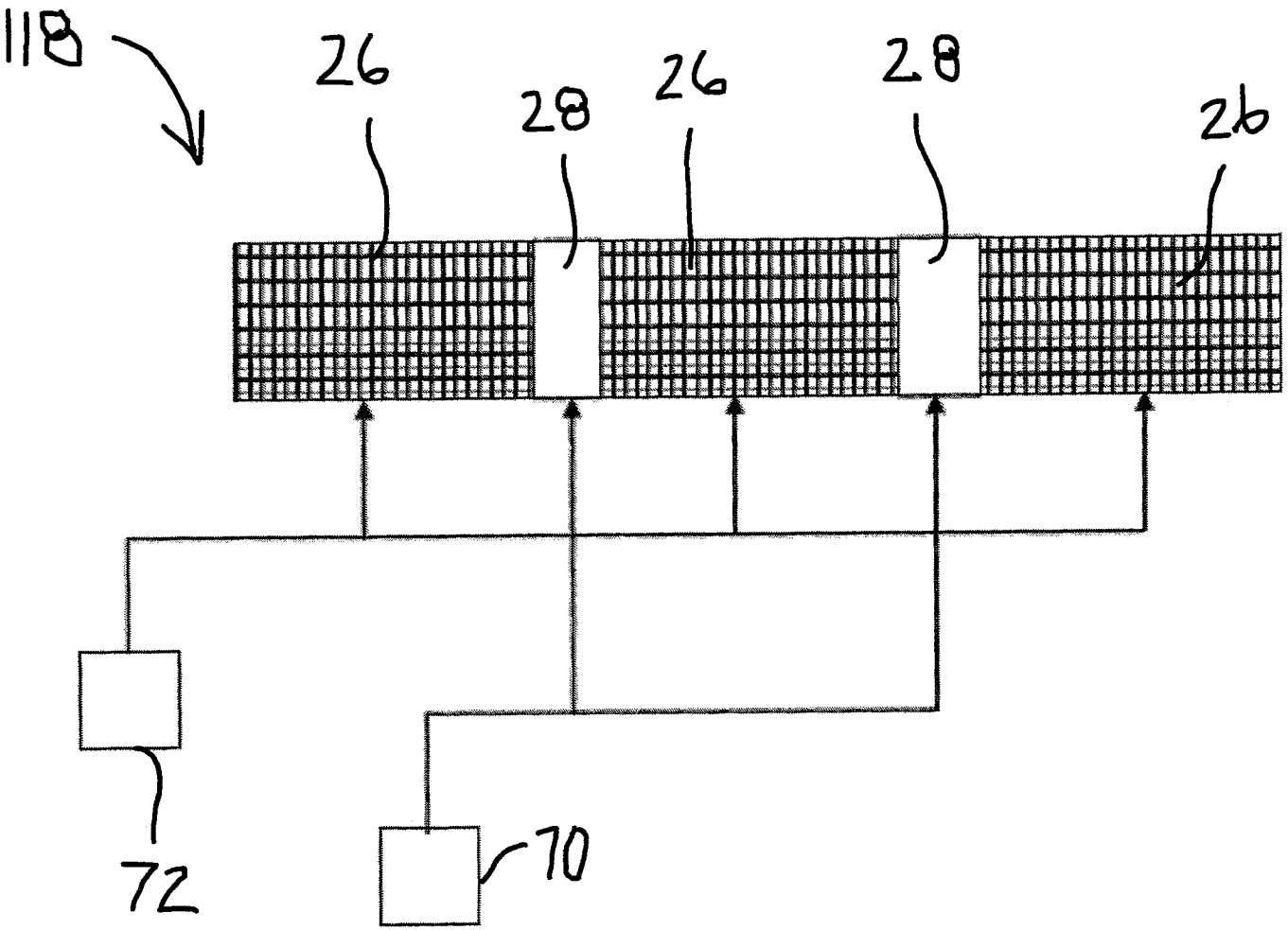
FIG. 11 is a schematic illustration of an air supply system for the bed, according to another embodiment of the invention.

With reference to FIGS. 10 and 11, in either embodiment, the sections 26, 126 and air bladders 28, 128 are fluidly connected to a source of air. For example, with reference to FIG. 10, the bladders 28 (or bladders 130, as the case may be) may be fluidly connected to a source 70 of air (which may also include a source of suction). In such case, the sections 26, and porous/honeycomb structure thereof, are also fluidly connected to bladders 28 so as to receive air therefrom. Fluid communication may be provided simply by the porous structure of sections 26 forming a sidewall of the bladders 28, or via a conduit or passage (not shown) between the sections 26 and bladders 28. In an embodiment, the conduit may include a valve, such as a one-way valve, permitting air to only flow from the bladders 28, 128 to the sections 26, 126, but not the reverse.

As shown in FIG. 11, the sections 26, 126 and bladders 28, 128 may each have a dedicated/separate source 72, 70 of air (which may also include a source of suction), respectively. In such embodiment, the sections 26 and bladders 28 are fluidly separate. In this manner, air can be selectively provided to either the sections 26, 126 or the bladders 28, 128, separately. In operation, in a stretcher mode, where bladders 28, 128 are in a deflated state, air from air source 72 may be activated to provide air to the sections 26. As a result of the porous or honeycomb structure thereof, the air diffuses throughout the sections 26, 126. In an embodiment, the air from source 72 can be heated or cooled (by heating or cooling the air before providing it to the sections 26, 126), in order to heat or cool a patient, as desired. In a bed mode, where the bladders 28, 128 are inflated, the air from source 70 can, likewise, be heated or cooled, to provide heating or cooling to a patient (in addition to the heating/cooling provided by the sections 26, 126).

Figure 5:
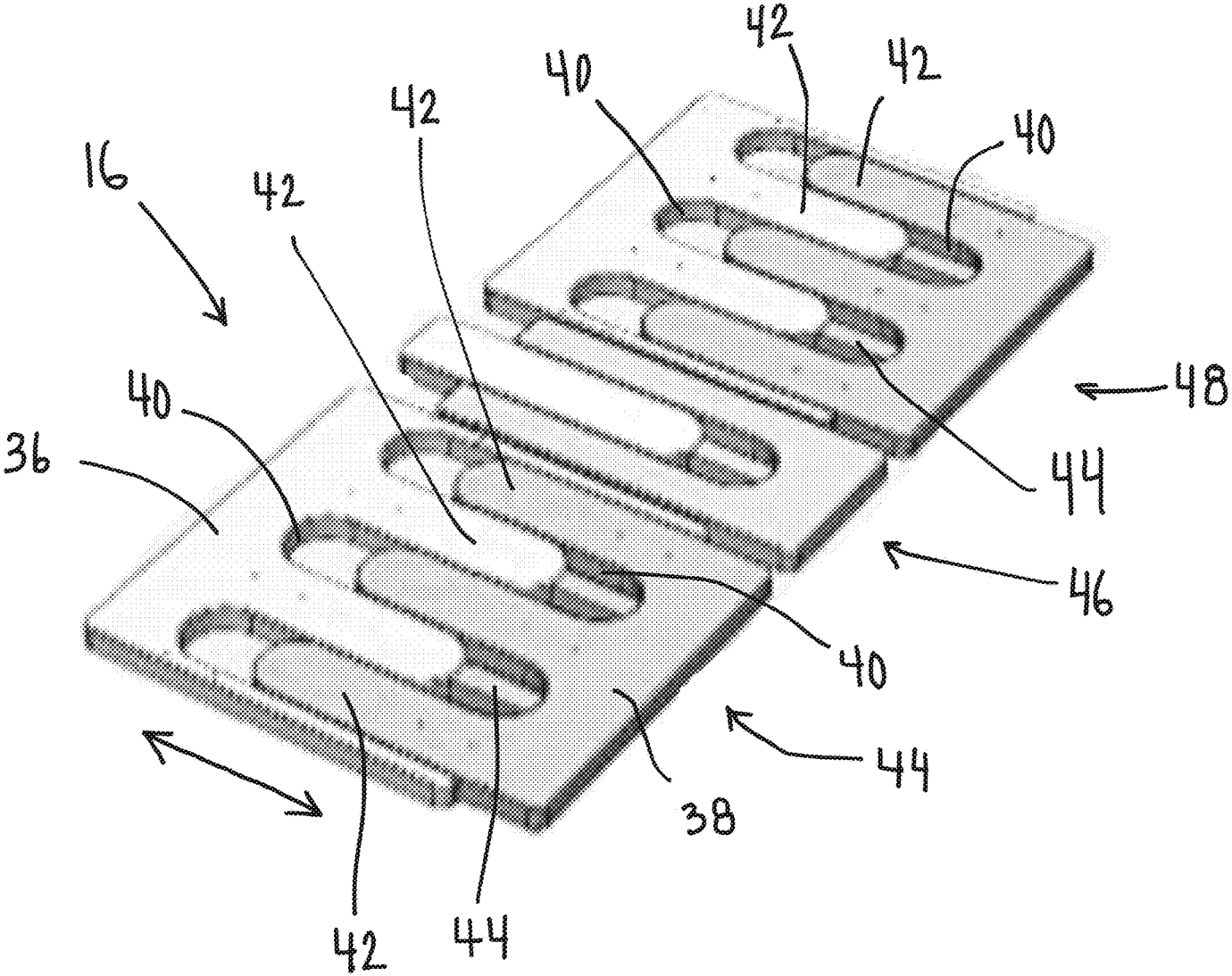
FIG. 5 is an enlarged, perspective view of a frame of the bed of FIG. 1.

Turning now to FIG. 5, the frame 16 of the bed assembly 10 on which the mattress 18 or mattress 118 is supported includes opposed first and second sections or panels 36, 38, each having a plurality of slots 40 and fingers 42. As shown therein, the slots 36 in the first/left section 36 receive the corresponding fingers 42 of the second/right section 38, and the slots 36 in the right section 38 receive the corresponding fingers 42 of the first/left section 36. In an embodiment, the slots 42 of the second section 38 may also include ribs 44 that are received by corresponding channels (not shown) in the fingers 40 of the first section 36. The first and second sections 36, 38 are thus interleaved with one another, such that the width of the frame 16 can be increased (by urging the first and second sections 36, 38 away from one another) or decreased (by pushing the first and second sections 36, 38 towards one another) as indicated by the arrow. In any event, importantly, the first and section sections 36, 38 have a tongue-and-groove like connection so that the sections be slidably nested with one another, and so that the frame 16 remains substantially rigid in both the extended and retracted positions.

Similar to the mattress 18, the frame 16 may include a plurality of distinct regions, including a lower region 44, an intermediate region 46, and an upper region 48, allowing the frame 16 to be moved between flat and inclined positions. Moreover, in an embodiment the lower region 44 may be lifted or inclined relative to the rest of the frame, similar to the manner in which the upper region 48 can be inclined. Each region 44, 46, 48 of the frame 16 has the ability to extend.

In an embodiment, the frame 16 may be connected to an actuator (e.g., a leadscrew or linear actuator (e.g., a hydraulic, electric or pneumatic actuator) that is controllable to selectively expand and contract the frame 16. Alternatively, or in addition, the frame 16 may be manually adjustable by a user or technician by manually pushing the first and second sections 36, 38 towards one another to decrease the width of the frame 16, or by manually pulling the first and second sections 36, 38 away from one another to increase the width of the frame 16. In another embodiment, the mattress 18 may be physically connected to the frame 16 such as, for example, using Velcro, mechanical fasteners, straps, or the like, so that expansion or contraction of the mattress 18 causes a corresponding expansion or contraction of the fame 16 via such mechanical interconnection. In yet another embodiment, the bed assembly 10 includes retractable frame rails 50 connected to the frame 16. In such embodiment, as the mattress 18 is expanded in width by inflating the bladders 28, the mattress 18 pushes outwardly on the frame rails 50, causing the first and second sections 36, 38 of the frame to slide in opposite directions and thus increase the width of the frame 16.

As indicated above, the bed assembly 10 is thus configured to be selectively increased and decreased in width by inflating or deflating the air bladders 28 of the mattress 18. Once inflated, the air bladders 28, in conjunction with the solid sections 26, provide and maintain a comfortable platform for a patient. In an embodiment, the mattress 18 and frame 16 can be increased by about 6 inches in width, or to about the size of a twin sized bed, in order to accommodate patients of different size, or when admitting a patient to a room after moving from the emergency department or diagnostic testing. In an embodiment, the air can be heated or cooled (either prior to or after filling the bladders 28) to heat or cool the patient depending on their medical condition and comfort level. For example, a burn patient may need the mattress 18, 118 to be as cool as possible, where as a heart attack or hypothermia patient may need to be kept warm. This temperature regulation also helps prevent bed sores while maintaining patient comfort.

Figure 6:
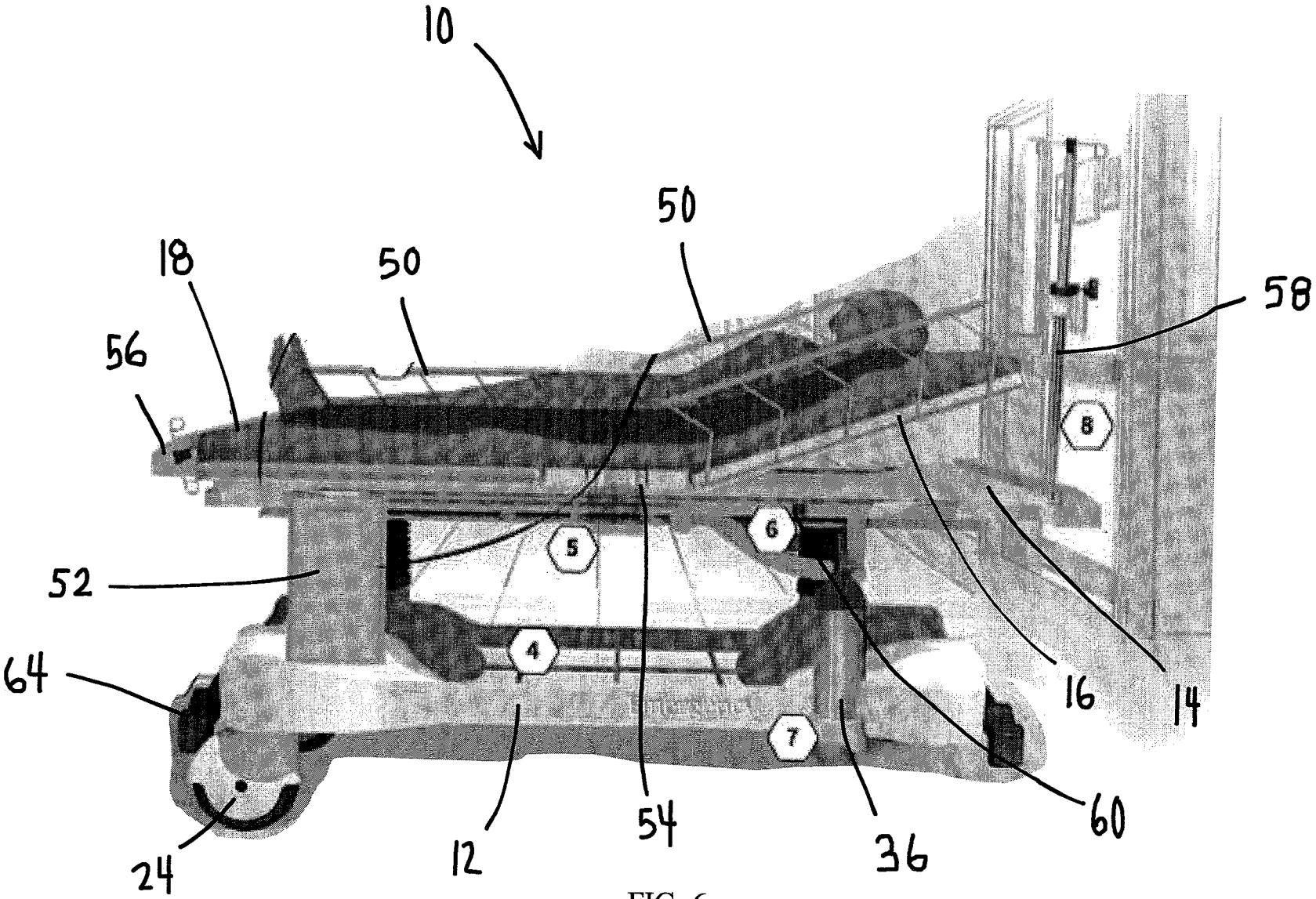
FIG. 6 is another perspective view of the bed of FIG. 1.
Figure 7:
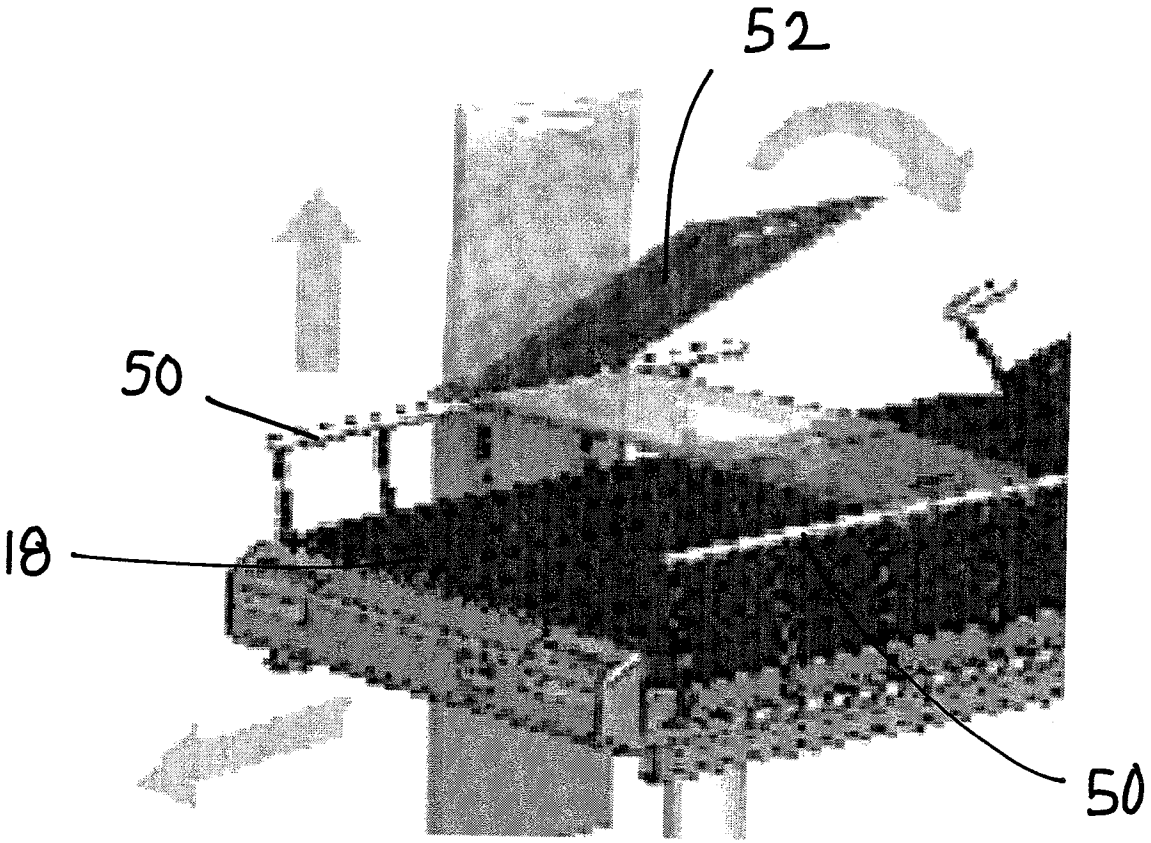
FIG. 7 is a perspective view of an adjustable eating table of the bed of FIG. 1.

With reference to FIGS. 6-9, the bed assembly 10 of the present invention includes a number of peripherals that provide for a level of functionality heretofore not seen in the art. For example, as shown in FIGS. 6 and 7, the bed assembly 10 includes an adjustable table 52. As best shown in FIG. 7, the table 52 is moveable between a deployed position where it is supported on opposing ends by the frame rails 50 on opposing sides of the bed assembly 10 and extends horizontally, and a stowed position where it is oriented in a vertical position along the side of the bed assembly 10 and positioned beneath the mattress 18 and frame 16 where it is out of the way. The table 52 can be used for eating for supporting medical equipment when in use.

Figure 8:
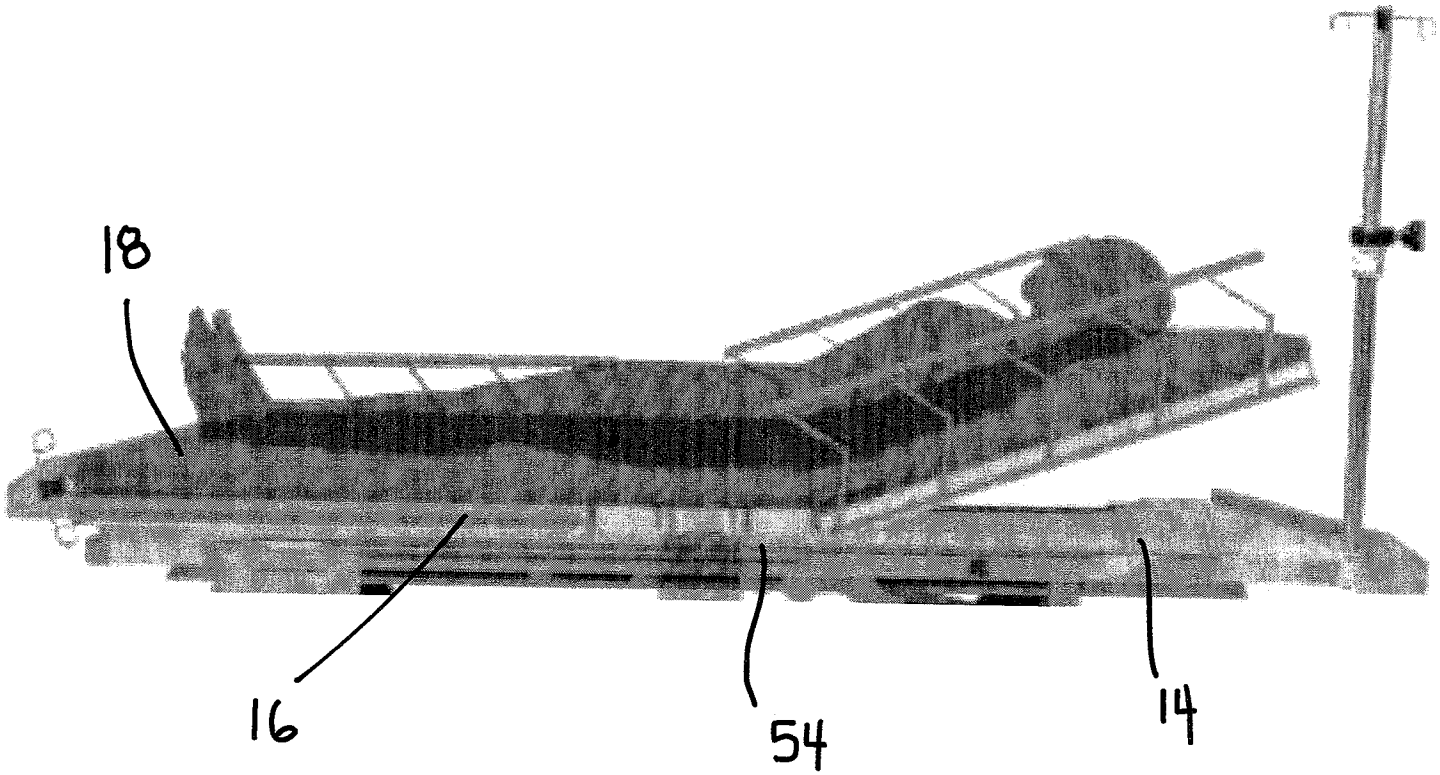
FIG. 8 is an enlarged, perspective view of a portion of the bed of FIG. 1.

As shown in FIG. 8, the frame 16 and/or support 14 of the bed assembly 10 may include an embedded or recessed area 54 to hold specialized medical equipment, such as chest tube holders, to maintain patient safety and treatment during transfers.

Figure 9:
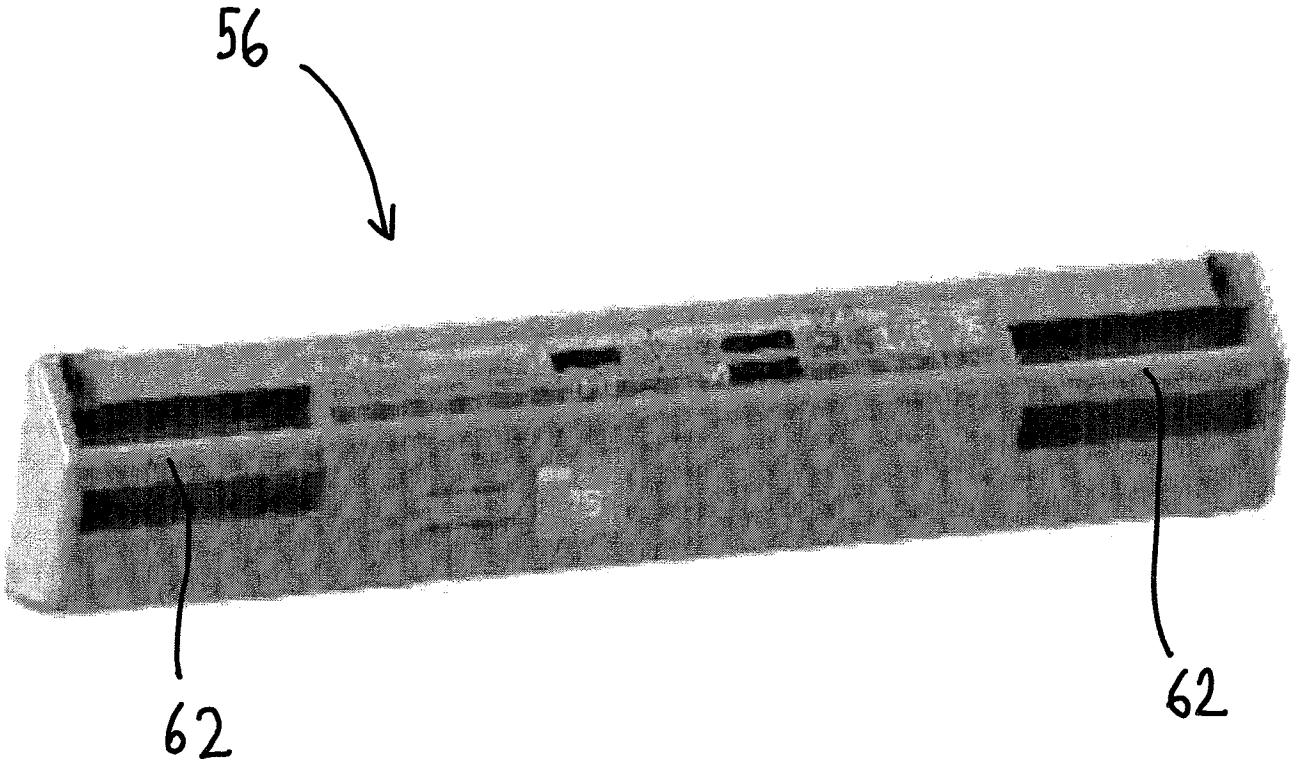
FIG. 9 is an enlarged, perspective view of a vitals monitoring interface of the bed of FIG. 1.

With respect to FIG. 9, the bed assembly 10 has the capability of weighing every patient. Additionally, sensors may be integrated along the sides to monitor if a patient comes off the bed. An ankle bracelet may also be used to monitor the patient. This provides the ability to monitor vital signs 24/7. As shown in FIG. 9, the foot of the bed assembly includes an interface/display 56 which can communicate wireless with various sensors and diagnostic tools for display of acquired information (e.g., heart rate, blood pressure, oxygen saturation, temperature, etc. The interface 56 is configured to wirelessly communicate with a central monitoring station for communicating such information thereto. The interface 56 also includes a pair of handles 62 to allow for movement of the bed assembly 10. The bed assembly 10 can also accommodate up to two IV poles 58. Two larger wheels 24 at the head of the bed assembly 10 assist in easier movement. Front control pedals 64 are provided for manipulation and movement of the bed assembly 10. The bed assembly 10 may also include an emergency CPR handle 60 that can be used in emergencies. The handle 60 can lay down, deflate the mattress, and take down the guards to make it easier to perform emergency CPR on the patient. As shown in FIG. 6, the bed assembly 10 may include a bracket for holding an oxygen tank 36.

In an embodiment, the underside of the frame 16 or support 14 may have a track for removably receiving a bin for receiving clothing or other items of a patient. The track may be, for example, accessible from the foot of the bed.

The bed assembly 10 of the present invention thus provides a cost-effective means for accommodating a patient within a hospital or healthcare facility because once it is assigned to the patient, it can stay with them for their entire stay. This dramatically decreases the time needed for cleaning and preparing a patient's room. As described above, the bed assembly 10 of the present invention not only simplifies a patient's transfer from bed to bed but would also decrease the risk of cross contamination along the patient's transfer points from one department to another. The bed assembly 10 limits the waiting time for a bed to be admitted to a floor, time spent cleaning and reorganizing a room for the new admission. It also facilitates the movement of patients within a hospital. As disclosed above, the bed assembly 10 may include handles, front control pedals, collapsible guards/rails, a light-weight frame, chest tube space, CPR handle, oxygen canister holder, front/back collapsible IV poles, a fully adjustable eating table, vital preview device, and a dual air-gel mattress pump control system. The adjustable frame 16 includes sliding panels that are expandable, providing additional comfort, 0 gap transfer and the firmness makes it easy for the patient to stand up from a rested position. The invention may also have recessed side extension that rest underneath or on the side of the gurney. In between the layered gel is an open space where air is located, that may be used for cooling or expanding the area of the platform. Not shown, but included in the lower extremity areas of the gel platform, is an air system used to blow air throw the gel and control the temperature (e.g., the embodiment of FIG. 3).

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A bed assembly, comprising:

a frame; and a mattress receivable on the frame, the mattress including a plurality of longitudinally-extending sections and at least one bladder;

wherein the at least one bladder is inflatable to increase a width of the mattress;

wherein the frame includes first and second panels interleaved with one another;

wherein the first and second panels are moveable away from one another to increase a width of the frame and towards one another to decrease a width of the frame;

wherein the first panel includes a plurality of fingers and a plurality of slots; and wherein the second panel includes a plurality of fingers and a plurality of slots configured to interface with the plurality of fingers and the plurality of slots of the first panel.

2. The bed assembly of claim 1, wherein:

the at least one bladder is intermediate longitudinally-extending sections of the plurality of longitudinally-extending sections.

3. The bed assembly of claim 1, wherein:

the at least one bladder is a plurality of bladders; and wherein each longitudinally-extending section is separated from another longitudinally-extending section by a bladder of the at least one bladder.

4. The bed assembly of claim 1, wherein:

the plurality of longitudinally-extending sections are formed from a gel or a memory foam.

5. The bed assembly of claim 4, wherein:

the plurality of longitudinally-extending sections include a horizontal air bladder.

6. The bed assembly of claim 1, further comprising:

an actuator configured to move the frame between expanded and contracted positions.

7. The bed assembly of claim 1, wherein:

the mattress is mechanically connected to the frame such that expansion of the mattress causes a corresponding expansion of the frame.

8. The bed assembly of claim 1, further comprising:

a base; and at least one actuator intermediate the base and the frame, the at least one actuator being configured to adjust a height of the frame and the mattress above the base.

9. The bed assembly of claim 8, further comprising:

a support platform underneath the frame.

10. The bed assembly of claim 1, wherein:

the mattress is expandable in width by about 6 inches.

11. The bed assembly of claim 1, further comprising:

at least one of a heating mechanism and a cooling mechanism for heating and/or cooling air in the at least one air bladder.

12. A method for configuring a bed, comprising the steps of:

providing a mattress having a plurality of solid sections and a plurality of air bladders interposed between the plurality of solid sections;

inflating the plurality of air bladders to increase a width of the mattress; and increasing a width of a frame supporting the mattress;

wherein the frame includes first and second panels interleaved with one another;

wherein the first and second panels are moveable away from one another to increase the width of the frame and towards one another to decrease a width of the frame;

wherein the first panel includes a plurality of fingers and a plurality of slots; and wherein the second panel includes a plurality of fingers and a plurality of slots configured to interface with the plurality of fingers and the plurality of slots of the first panel.

13. The method according to claim 12, further comprising the step of:

evacuating air from the plurality of air bladders to collapse the plurality of bladders and decrease the width of the mattress.

14. The method according to claim 12, wherein: the step of increasing the width of the frame includes actuating a linear actuator.

15. The method according to claim 12, wherein: the mattress is mechanically interconnected with the frame.

16. An expandable bed system, comprising:

a frame; and a mattress receivable on the frame, the mattress a plurality of solid sections and a plurality of air bladders interposed between the plurality of solid sections; and a source of pressurized air in fluid communication with the plurality of bladders;

wherein the plurality of bladders are inflatable to increase a width of the mattress;

wherein the frame includes first and second panels interleaved with one another and which are moveable away from one another to increase a width of the frame;

wherein the first panel includes a plurality of fingers and a plurality of slots; and wherein the second panel includes a plurality of fingers and a plurality of slots configured to interface with the plurality of fingers and the plurality of slots of the first panel.

* * * * *